United States Patent [19]

Gomes et al.

[11] Patent Number: 4,907,695

[45] Date of Patent: Mar. 13, 1990

[54] ROBOTIC PALLET/CONTAINER

[75] Inventors: Peter F. Gomes, Belle River; Brian W. Schisler, Amherstburg, both of Canada; Gary L. Mooneyham, Rochester, Mich.

[73] Assignee: Ford Motor Company, Dearborn, Mich.

[21] Appl. No.: 401,703

[22] Filed: Aug. 31, 1989

[51] Int. Cl.[4] ..... B65D 19/00

[52] U.S. Cl. ..... 206/386; 206/600

[58] Field of Search ..... 206/386, 595, 596, 600, 206/599

[56] References Cited

U.S. PATENT DOCUMENTS

| | | | |
|---|---|---|---|
| 2,457,262 | 12/1948 | Norquist . | |
| 3,369,973 | 2/1968 | Voigt et al. . | |
| 3,643,812 | 2/1972 | Mander et al. . | |
| 3,691,965 | 9/1972 | Cloyd . | |
| 4,564,109 | 1/1986 | Stavio . | |
| 4,574,955 | 3/1986 | Camossi | 206/386 |
| 4,580,680 | 4/1986 | Wind | 206/386 |
| 4,594,216 | 6/1986 | Feutrel . | |
| 4,666,035 | 5/1987 | Johnson . | |
| 4,690,281 | 9/1987 | Berthet | 206/386 |
| 4,706,816 | 11/1987 | Fjallstrom | 206/386 |
| 4,838,419 | 6/1989 | Weits et al. | 206/386 |

*Primary Examiner*—Joseph Man-Fu Moy

*Attorney, Agent, or Firm*—Joseph W. Malleck; Roger L. May

[57] ABSTRACT

An article of manufacture formed as a protective positioning pallet for holding each of a plurality of articles in accurate spatial position. Also, a method of making such positioning pallet, and a method of using such positioning pallet in a robotics environment is disclosed.

The article of manufacture has a rigid exterior skeleton frame defining a cylindrical space, the frame having positioning surfaces outside of said space for accurately orienting said frame, and locator surfaces extending into said cylindrical space for locating parts therein relative to said positioning surfaces; one or more cradles are suspended across the locator surfaces in a predetermined fixed position relative to said frame for snugly holding the parts in part-to-part separation. Impact shielding walls are hung on said skeleton spaced from said cradles.

14 Claims, 6 Drawing Sheets

ROBOTIC PALLET/CONTAINER

BACKGROUND OF THE INVENTION

1. Technical Field

This invention relates to the art of containerization of goods and to the separate and independent arts of designing pallets (platforms for transfer of goods) and of transferring articles by robotic handling.

2. Description of Prior Art

Factory-of-the-future concepts will require automated transfer of goods in hybrid units that integrate functions, only some of which are found separately in shipping containers or in transfer pallets. The functions essentially comprise: (a) containerizing and protecting surface-delicate goods; (b) positioning such goods for accurate mechanical transfer; (c) versatile realignment of the container interior to accept varying sizes of goods; and (d) modularizing such containerization to fill standardized cargo space.

Pallets are movable platforms that provide a flat surface upon which goods are supported and have channels to receive arms of a forklift vehicle for transport. The pallets can be constructed from a variety of materials, including metal, molded plastics, or wood (see U.S. Pat. Nos. 3,691,965; 4,564,109). Wooden pallets are popular because of their economy, but fail to provide containerization or protection for the goods. They are readily damaged through use and must be discarded which imposes a difficult disposal problem. Most importantly, they fail to provide precision positioning of the goods as demanded for robotic transfer.

Shipping containers comprise an active art that has included clustering a plurality of goods within a casing while providing some form of good-to-good separation. The containers can be made from a variety of materials just like the pallets. Often, the good-to-good separation is provided by cardboard dunnage, discardable after use, causing an environmental disposal problem. Much of the advancement in containerization for elongated goods, such as shafts or rods, has come from industries dealing with dangerous cargo such as missiles, rocket motors, or nuclear rod assemblies (see U.S. Pat. Nos. 2,457,262; 4,666,035; 3,369,973; 4,594,216; 3,643,812). In the '262 patent, woods spacers are deployed within a metal shell to protect the rocket motors contained therein, but the entire structure must be dismantled to remove the articles, which does not lend itself to quick and accurate access for robotic transfer. In the '035 patent, plastic dunnage was deployed for separating and protecting explosive shells or missiles, the dunnage in turn being held together by a wire assembly. Although this construction provides for easy stacking and clustering of the articles for transportation, there is certainly no provision for precise handling and pickup in a robotic transfer environment.

In Soviet Union patent publication 1,312,009, a container was disclosed for enclosing a plurality of shafts, allowing the shafts to roll into indexable positions within the container locked in place by turnable separators, the shafts are similarly removed from the container by gravity, rolling out an end of the container with the separators moved to a neutral position. Such container design does not provide for protection that is needed for surface-delicate goods such as previously machined camshafts or crankshafts; the rolling contact would damage such surfaces. Moreover, if such containers ere to be stacked one upon the other, the loads transferred between containers would not be independent of the goods or articles within the container and thus would not provide the kind of protection needed for robotic handling.

SUMMARY OF THE INVENTION

The invention comprises (i) an article of manufacture formed as a protective positioning pallet for holding each of a plurality of articles in an accurate spatial position, (ii) a method of making such positioning pallet, and (iii) a method of using such positioning pallet in a robotics environment.

The article of manufacture comprises: (a) a rigid exterior skeleton frame defining a cylindrical space, the frame having positioning surfaces outside of said space for accurately orienting said frame, and locator surfaces extending into said cylindrical space for locating parts therein relative to said positioning surfaces; and (b) one or more cradles suspended across said locator surfaces in a predetermined fixed position relative to said frame for snugly holding said parts in part-to-part separation. Preferably, the pallet has impact shielding walls on said skeleton spaced from said cradles and spaced inwardly from the periphery of the cylindrical space.

Preferably, the positioning surfaces are on a steel bed forming part of the skeleton. The positioning surfaces may provide a plurality of functions including: access for arms of a forklift truck, accurate contact and positioning by a conveyor system, and accurate orientation of the pallet to a robotic station. The locating surfaces preferably comprise at least a pair of bushings stationed angularly at opposite sides of the frame and having surfaces finished and located to an accuracy of $\pm 0.004$ inches to each other. The locator surfaces also comprise locator posts fitted to such bushings.

The frame advantageously also carries stacking surfaces for transfer of loads between stacked pallets without contact between the shielding walls, locator surfaces, or cradles.

The cradles advantageously are structured to present selectively variable dunnage heights and are comprised of a dimensionally stable, tough material softer than the parts contained therein. The shielding walls for such article of manufacture includes a bottom, hinged top, and side walls to provide contamination protection.

The method of making comprises: (a) assembling a rigid frame having a bed with upright posts along the periphery of the bed to define a first interior cylindrical space; (b) machining a plurality of reference surfaces on said frame with sufficient accuracy to each other ($\pm 0.004$ inches) to define reference coordinates for said interior cylindrical space; (c) stationing locator posts on said frame by mating machined surfaces of said locator posts against said reference surfaces to obtain an accumulated stack-up of tolerances of about $\pm 0.045$ inches, said locator posts defining a second interior cylindrical space nested within said first interior cylindrical space; (d) suspending part-holding cradles on said locator posts to obtain an interfit between said cradles and locator posts equal to or less than 0.045 inches; and (e) hanging shielding walls on said upright posts of said frame to substantially close off said first interior cylindrical space.

Preferably, the bed has a rectangular plan configuration, with upright load-bearing posts located at the corners of such configuration. The uprights posts and bed are comprised substantially of hollow, tubular members. Advantageously, the frame and locator posts are constructed of steel, and the cradle and shielding walls are constructed of tough, dimensionally accurate plastic. Preferably, the cradle is constructed of a plastic having a shrinkage characteristic which is equal to or less than 12 in/in/$10^{-6}$ and a toughness characterized by at least 10 ft/lbs. Preferably, the shielding walls are constructed of a plastic having an impact strength of at least 12,000 S.G. and a toughness characterized by a strength of at least 14 ft/lbs.

The reference surfaces are preferably comprised of at least one pair of bushings located at opposite sides of the bed; such reference surfaces are positioned by combination of a diamond shape and a round pin shape as orienting members associated with a robot station.

Another aspect of this invention is a method of handling parts for precision work, comprising: (a) containerizing the parts within a positioning pallet having a rigid bed with reference locating surfaces, said parts being coordinated to said locating surfaces within a dimensional accuracy of equal to or less than 0.06 inches, said pallet having transfer rails projecting from said bed to function as conveyor locating surfaces; (b) conveying said pallet with said transfer rails aligned with the sides of the conveyor to a predetermined station adjacent a robot; (c) controlling such robot to move to said predetermined station, open said container, and selectively grip one or more exposed portions of said parts in said station; (d) robotically moving said gripped parts from said container to a work station for performing work tasks thereon; (e) robotically returning said parts to their cell within said container upon completion of said work; and (f) vertically stacking said repacked containers for conveyance, each container separating and isolating support forces from said parts.

Preferably, the pallet is a hybrid of a metal bed and frame within which is nested plastic part cradles in accurate spaced relationship to said frame. Advantageously, the bed has separate surfaces for (i) receiving forklift arms, (ii) contacting conveyor rollers, and (iii) resting on a platform. The container is oriented to its predetermined station adjacent the robot preferably by the use of diamond shape and a round pin locating means. Once oriented, and the robot is programmed to move to a point in space to grip such parts without sensing the position of the parts themselves.

DETAILED DESCRIPTION AND BEST MODE

The positioning pallet of this invention simultaneously meets many demands: (1) provides for pallet placement on conveyors, (2) provides for precision part placement at robotic load/unload stations; (3) holds and protects parts against damage during transit and storage and provides part-to-part protection; (4) modularizes to provide for stacking with a small footprint and to optimally occupy a maximum interior volume of trucking trailer in accordance with the cubing-out concept; provides a high part density; (6) eliminates throw-away dunnage by reuse; (7) provides reduced handling by improving ease of forklift usage, ease of conveyor belt usage, and ease of stacking; (8) accommodates different shaped parts; and (9) has improved strength/weight ratio.

Figure 1:
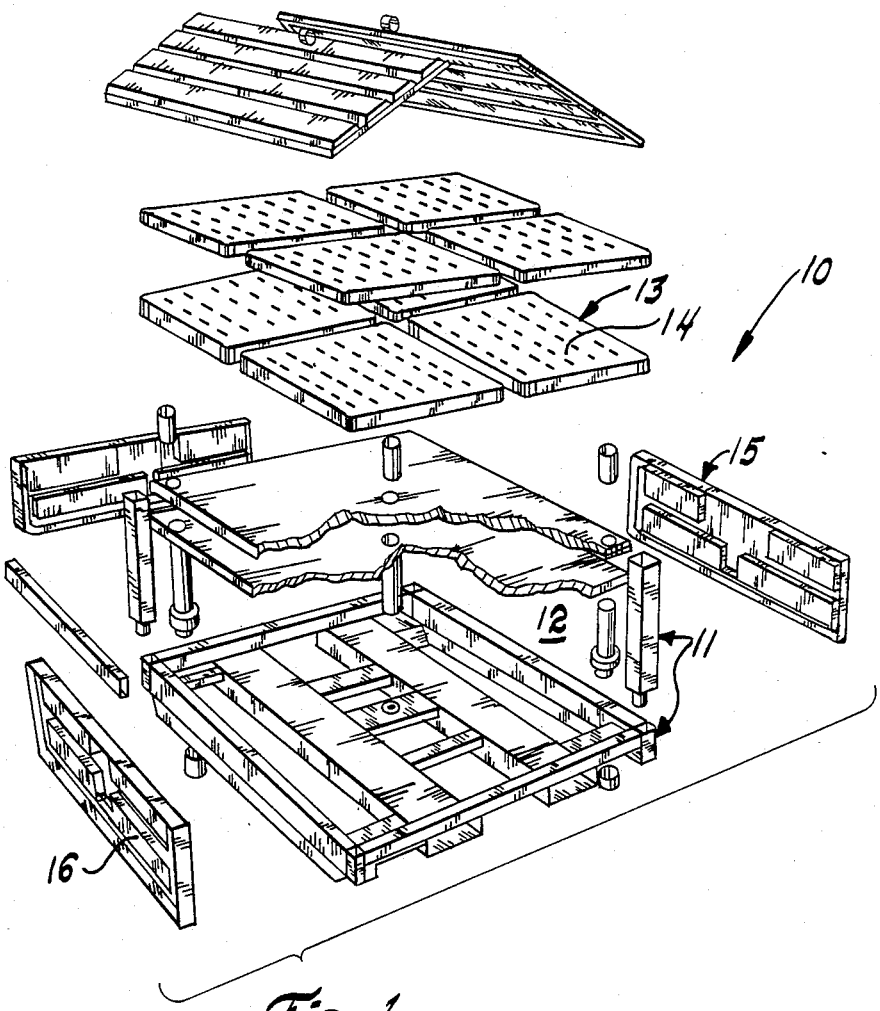
FIG. 1 is an exploded view of a positioning pallet embodying the principles of this invention.

The apparatus aspect of this invention is a robotic-friendly positioning pallet 10 (see FIG. 1) that essentially consists of the following: (a) heavy load bearing rigid frame and base system 11 to define an interior cylindrical space 12; (b) a cradle system 13 suspended within such space 12 to be separated from the frame and base 11, and constructed of a dimensionally stable and tough material that is softer than the parts contained thereby; (c) impact shielding wall system 15 hung on the rigid frame and base 11 to enclose the cylindrical base 12, such wall system being comprised of a lightweight material 16 that has high impact strength and toughness and superior resistance to abuse from crushing or deformation.

Turning now in more detail to such mechanical systems, the frame and base system 11 is shown more fully in FIGS. 3, 6, 7, 8–11. The base or bed 20 is comprised of a series of welded steel tubular rails forming a generally square layout. Double high cross rails 22, 23 of shallow height have their ends welded to side rails 21 and 24. The upright posts 34 may be welded to the exposed ends of each of the cross rails and side rails at corner locations to accommodate a flush exterior periphery of the base frame with the posts thereby recessed. The four posts and base together define a first interior cylindrical space 35.

The bottom cross rail (22*a* or 23*a*) is interrupted to receive fork lift channels 25 aligned with the side rails 21, 24 but spaced inwardly therefrom to extend the full width of the base. Web plates 26, 27, 28 and 29 are welded in place at the interior corners of the rails to be aligned with plane 30 of the base. Another web 31 is welded in place between the forklift channels 25 at the center of the base. Braces may be added at either side of the web 31 to further rigidify the base. Transfer rails 32, 33, each having a right angled cross-section, are welded to the remote bottom corners of the channels to function as contact surfaces with mating surfaces of conveyor rollers used in transporting such positioning pallet. A floor 38 and neoprene pad 39 are laid across the top surface 37 of the base.

The cradle system 13 achieves locational accuracy for the parts contained therein by queing on reference surfaces 40 (see FIGS. 3 and 7) formed on the rigid base. These reference surfaces are internal cylindrical surfaces machined into hard metal bushings 43. These bushings 43 are welded in place with their axes 44 in an upright position through an opening 45 in at least two of the webs (selected from 26, 27, 28 and 29) thereby providing diagonally cross-corner alignment; central alignment is provided if the central web 30 is used also. Each of the internal and external cylindrical surfaces are machined and located to an accuracy of at least ±0.004 inches to each other.

Both the bushings 43 and the transfer rails 32, 33 are protected from side forces or destruction by being surrounded by side rails 21, 24, skids 26, and cross rails 22, 23. Each bushing 43 is additionally recessed within heavy web plates for protection and rigidity. This protection for such critical surfaces is unique.

Locator surfaces 36 extend from the reference surfaces 40 into the interior cylindrical space 35 by use of dimensionally stable locator posts 45. Each have a hollow interior and are mounted onto a bushing 43 by use of a stepped flange 46 having a central trunion 47 adapted to fit within the internal diameter of the bushing. The interfit between the outside diameter of the trunion 47 and the inside diameter of the bushing must provide a snug interfit (i.e., 0.001–0.002 inch). The flange 47 of each of the locator posts 45 overlays the floor 37 of the positioning pallet.

Figure 3:
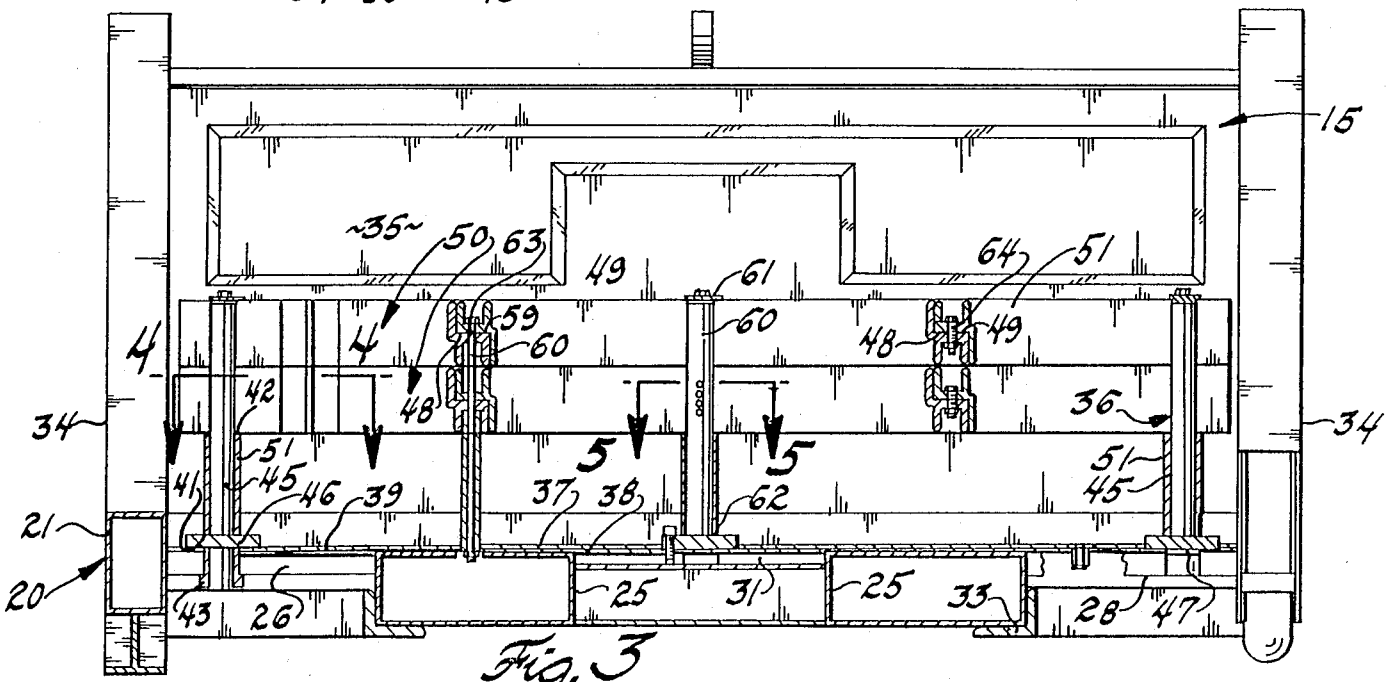
FIG. 3 is a partial sectional elevational view of a positioning pallet taken along line 3—3 of FIG. 8.
Figure 6:
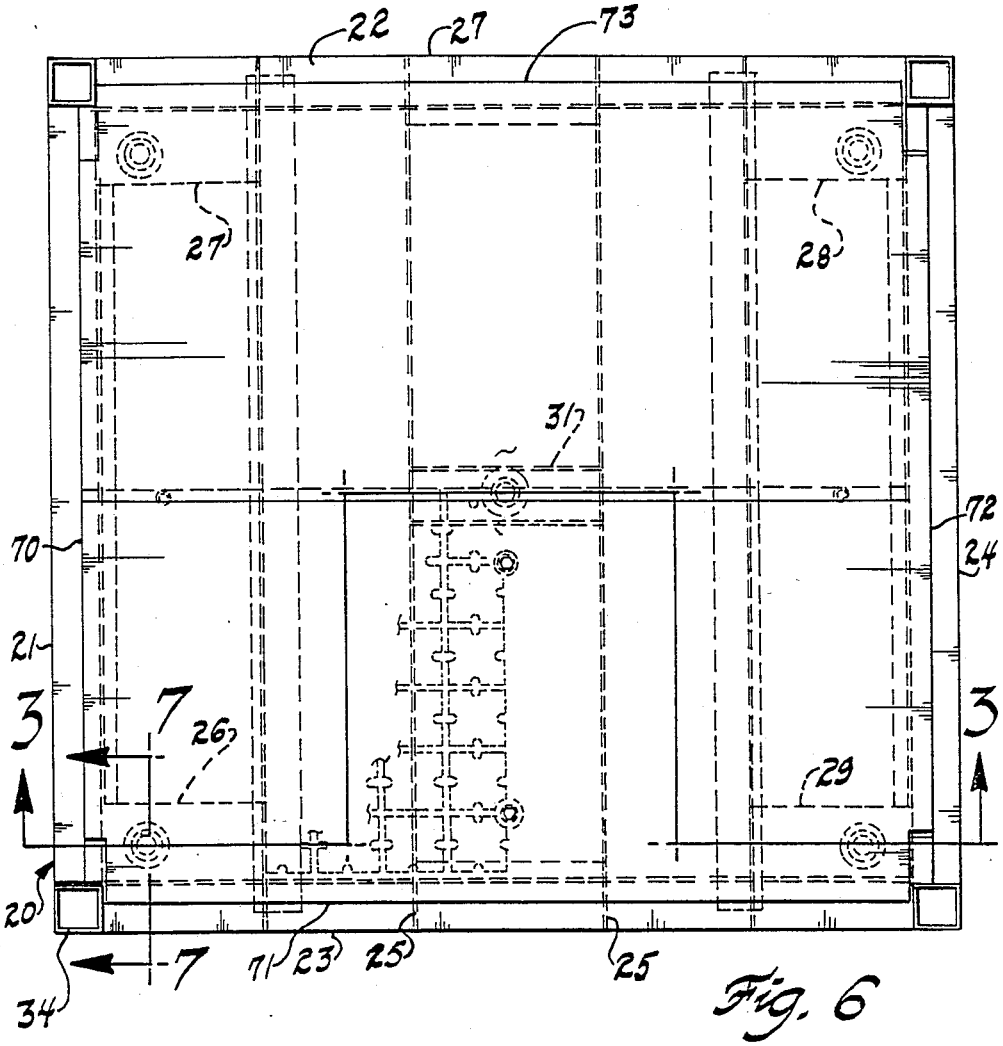
FIG. 6 is a plan view of a positioning pallet showing internal members in dashed outline.
Figure 7:
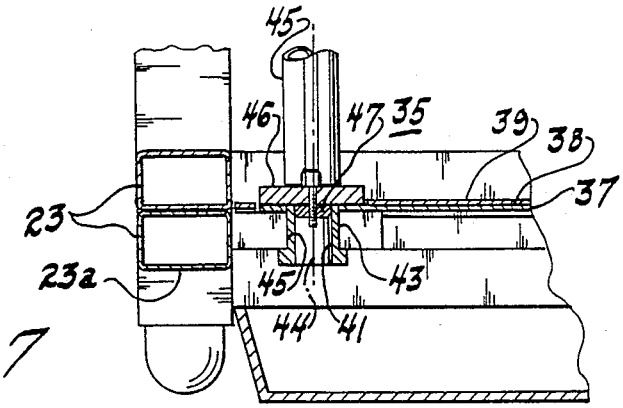
FIG. 7 is an enlarged sectional view of a portion of FIG. 6 taken along line 7—7 thereof.
Figure 11:
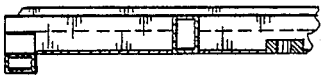
FIG. 11 s a sectional view taken substantially along line 11—11 of FIG. 8.
Figure 10:
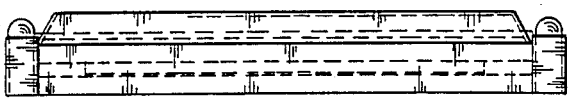
FIG. 10 is a side elevational view of the construction shown in FIG. 8.
Figure 8:
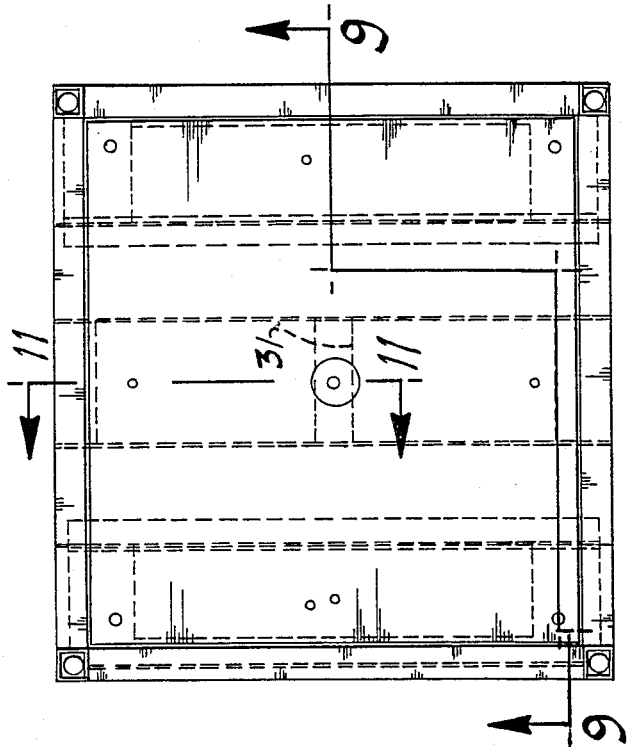
FIG. 8 is a plan view of the bed frame forming part of the positioning pallet of FIG. 2.
Figure 9:
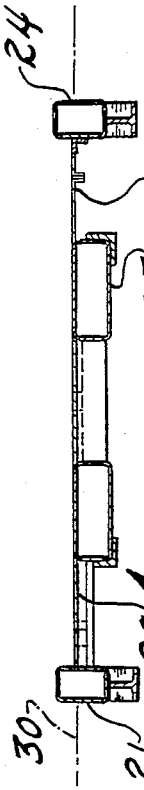
FIG. 9 is a front elevational view of the bed frame of FIG. 8.
Figure 14:
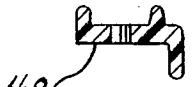
FIGS. 14, 15 and 16 are views taken respectively along lines 14—14, 15—15, and 16—16 of FIG. 12.
Figure 15:
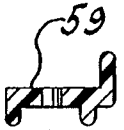
Figure 16:
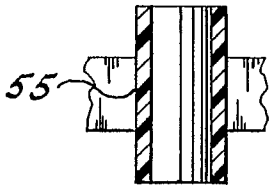
Figure 12:
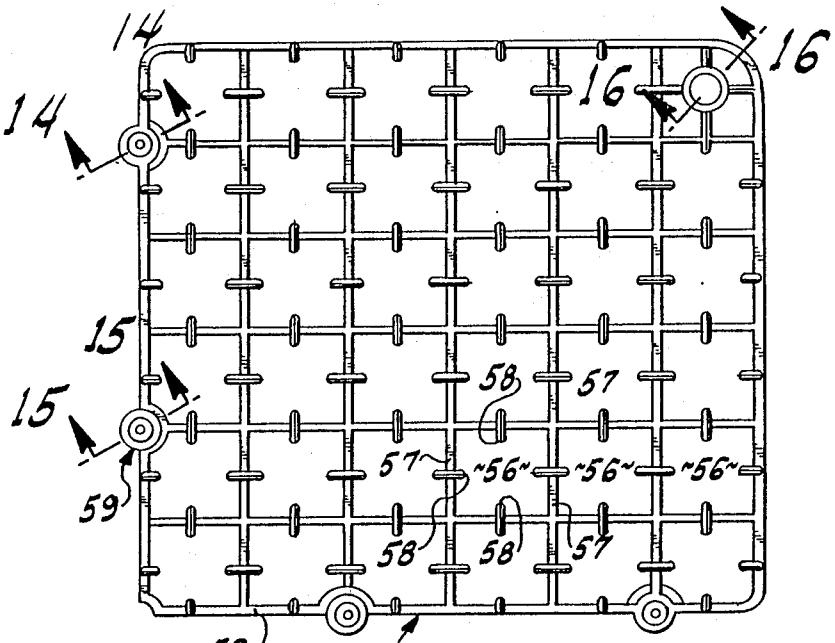
FIGS. 12 and 13 are respectively plan and elevational views of one cradle quadrant.
Figure 13:
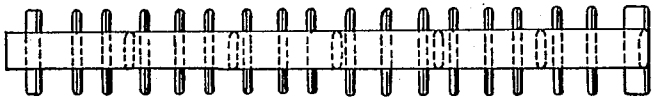

Suspended on the locator posts 45 is egg-crate styled cradles 50 by use of spacer sleeves 51 concentrically slid down onto each post 45 (see FIG. 3). The lower edge 41 of each spacer sleeve abuts the flange 46 of the post 45 and the opposite edge 42 serves as a stop or ledge upon which is stationed the cradles 50. Each cradle may preferably be formed of a high impact strength and dimensionally stable plastic such as Xenoy, a polyester based material manufactured by General Electric Plastics, which has performance characteristics that exceed more expensive super-tough nylons. Such plastic has a notch izod value at 60° F. of at least 10 ft/lb/in (impact strength value). Such plastic also has a dimensional stability characterized by a mold shrinkage of less than 12 in/in/$10^{-6}$. Such plastic additionally provides a hardness which is less than the hardness of the parts to be contained thereby.

Alternatively, one or more of such cradles may be supported by wire mesh grids serving as a reinforcement for such cradles or as a replacement for such cradles. Such wire mesh grids should be preferably cadmium plated and comprised of fabricated steel wire.

Each cradle system spans the planar cross-section of space between the locator posts 45 and is preferably comprised of four modular quadrants 49, 51, 52 and 53 (the latter not shown), see FIGS. 3–5 and 12. Each quadrant has a rounded corner 54 with an integral sleeve 55 adapted to surround the associated locator post 45. The interfit between the integral sleeve 55 and the locator post is precise to thereby regulate the positioning of the parts within each cell 56 of the cradles. Each cell 56 of the cradle is formed by four rectangular or squared flat walls 57, each having inwardly protruding rounded shoulders 58 extending from the midline of each of the walls 57. The extent of protrusion is determined by the need to accommodate the shape of the part to be cradled. In the case of a camshaft, the shoulders will extend inwardly in a radial direction of the camshaft to contact the camshaft periphery snugly and hold the centerline of the camshaft in a predetermined spatial position. The shoulders may be only one-half the height of the cell walls.

The quadrants are locked together at overlapping stepped joints 59 by use of fasteners 64 which hold together mating surfaces 48 and 59. It may be desired to stack two layers of cradles, one upon the other, as shown in FIG. 3, to more fully position and cradle elongated parts, such as camshafts. The camshafts will be inserted through the aligned cells of the two layers of cradles, with one end of each camshaft resting on the neoprene pad of the floor. Two or more layers of cradles can be unitized and secured to the base by extension bolts 60 either extending concentrically through a locator post between a clamping washer 61 and a suitable shoulder 62 of the post flange in the case of the locator post, or through aligned openings 63 in the center of the overlapping joints of the cradles.

To accommodate different shaped parts, other cradles may be substituted with walls and protrusions redesigned to dimensionally accept the different part. The modular dunnage is layered so that by changing the grid size and the position of shoulders which secure the camshaft main diameters, a variety of configurations can be accommodated. Within the interior height of the cylindrical space, one or more of the cradles can be deployed in varying heights as desired. It is within the scope of this invention to substitute other materials for the posts and for the cradles and panels as long as the main objective of positioning accuracy and protection is obtained.

The impact shielding wall system 15 comprises a series of upright side panels 70, 71, 72 and 73, and hinged cover panels 74 and 75. Each side panel fits between a pair of upright frame corner posts 34 and can be attached thereto by mechanical fasteners (i.e., rivets or bolts). The shielding wall system is spaced inwardly from the periphery of the cylindrical space 35 and spaced outwardly of the cradles. The cover panels 74, 75 are hinged along a line spanning along the upper edge of two opposed side panels 70, 73 and between two associated corner posts 34 for each of such panels. The cover panels 74, 75 are stopped in their fully opened position by indented or embossed ramp surfaces 76, 77 which interengage with the posts 34 allowing he cover panels to rest in an overbalanced position as shown. Lift rings 78, 79 are attached adjacent to the innermost edges of the cover panels for robotic lifting and thereby opening of the interior of the positioning pallet.

Such side panels and cover panels are preferably constituted of an impact resistant plastic such as Azdel, manufactured by General Electric Plastics. Such plastic is characterized by an excellent strength to weight ratio with a tensile strength of at least 12,000 S.G. The plastic also has a toughness characterized by a notched izod impact value of at least 14 ft/lbs.

In the apparatus illustrated, the positioning pallet here is designed for containerizing 140 camshafts, roughly equal to about 1400 pounds. The positioning pallet here is sized to have a 45"×48" footprint to maximize the used capacity within the interior of a standard semitrailer cargo section. The pallet has a designed height of 10–32 inches as a modular height (here about 27 inches to satisfy design criteria for the shafts to be contained), and when stacked two or three high, meets the interior volume of such standard semitrailer cargo portions.

To manufacture such protective positioning pallet, a preferred method for doing so comprises: (a) assembling a rigid frame having a bed with upright first posts along the periphery of the bed to define an interior cylindrical space; (b) machining a plurality of reference surfaces on the frame with sufficient accuracy to define reference coordinates for the interior cylindrical space; (c) stationing the machined surfaces of rigid locator posts within the interior of the cylindrical space in mating contact with the frame reference surfaces to obtain an accumulated stack-up of tolerances of about ±0.045 inches, the locator posts defining a cylindrical second space nested within said first cylindrical space; (d) suspending part-cradles on said locator posts to obtain an accumulated stack-up of tolerances of about 0.045 inches; and (e) hanging shielding walls on said upright posts of said frame to close off said interior cylindrical space.

It is desirable if the reference surfaces comprise at least one pair of circular bushings located at opposite or diagonal sides of the base. The bushings have a highly accurately machined internal surface which is to be contacted by highly precise diamond shape and round pin shape locating means when the pallet is to be exactly positioned for robot use (see FIG. 2).

The rigid frame is advantageously formed of welded hollow tubular members, both for the corner posts as well as the members defining a rectangular configuration for the base. The part-cradles may preferably be formed in quadrants which can be overlapped at interlocking joints to form a complete and installed section spanning the interior of the positioning pallet. The formation of the cradles and quadrants adds another element of modularity which provides for changeable configurations and shapes.

Another aspect of this invention is the method of handling parts for precision work, which essentially comprises: (a) containerizing the parts within a positioning pallet having a rigid bed with reference surfaces, the parts being coordinated to said references surfaces by locating surfaces within a dimensional accuracy of at least 0.06 inches, the pallet having transfer rails projecting from said bed to function as conveyor locating surfaces; (b) conveying the pallet with said transfer rails aligned with the sides of the conveyor to a predetermined station adjacent an unloading robot; (c) controlling such robot to move in space to the predetermined station and thence move to open the container and selectively grip one or more of the exposed portions of the parts at the station; (d) robotically moving the gripped parts from said container to a work station for performing work tasks upon the part; (e) robotically returning parts to the container upon completion of the work; and (f) vertically stacking the container for conveyance, each container separating and isolating the support forces from the parts.

Figure 2:
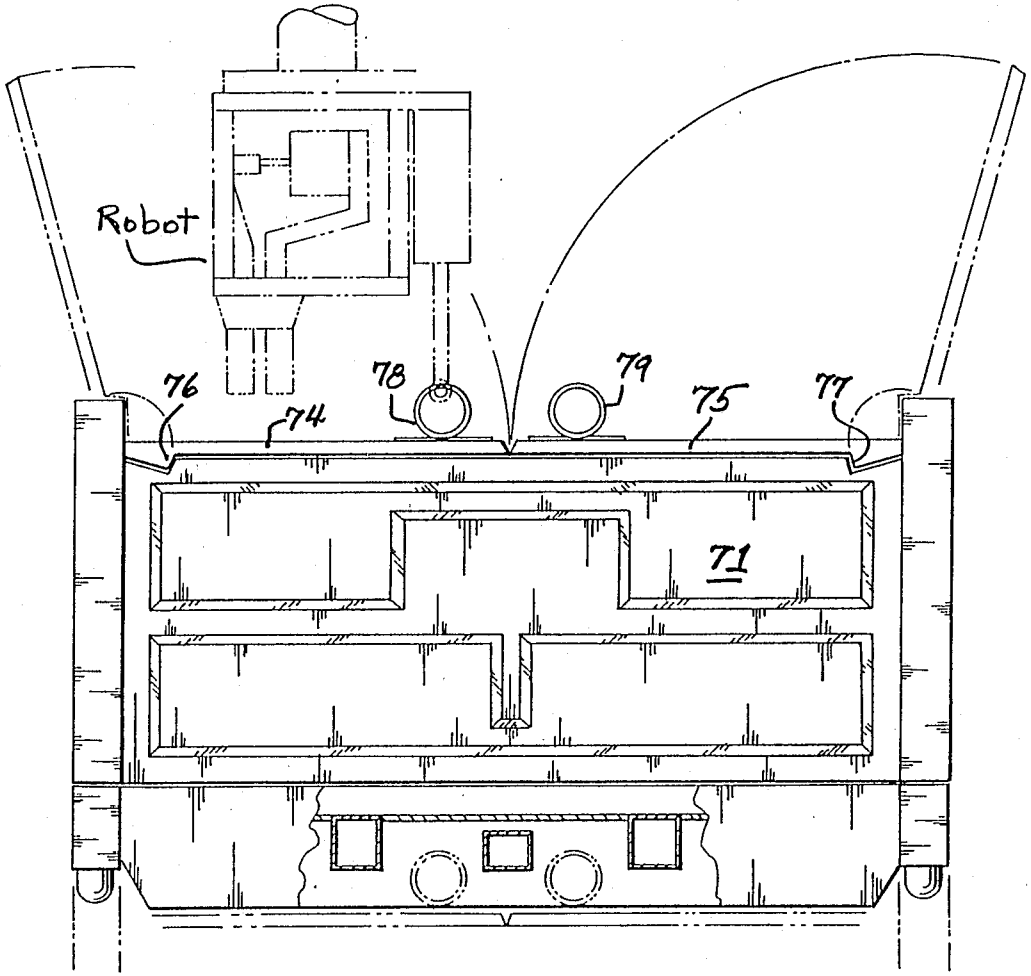
FIG. 2 is a side elevational view of the positioning pallet of FIG. 1, illustrating robotic removal of parts contained therein.
Figure 5:
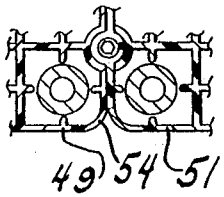
FIGS. 4 and 5 are fragmentary sectional views taken, respectively, along lines 4—4 and 5—5 of FIG. 3.
Figure 4:
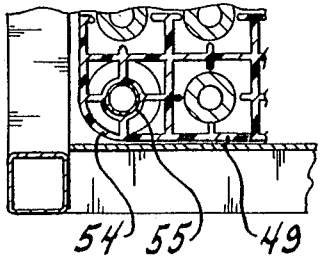

Such method is more graphically depicted in FIG. 2 where a robotic head is shown as having moved by conveyor to a position to engage the lift rings and start an upward swinging motion to pivot the cover panels and expose the containerized parts. The positioning pallet is roughly aligned on a conveyor system having conventional roller type conveyors by virtue of the transfer rails 32, 33 mounted on the underside of the pallet. Angle members on the forklift channels act as transfer rails to transfer the load of the pallet to the cylindrical rollers of the conveyor system. Complementary angled surfaces of the conveyors assure alignment of the pallet during transit. With the cover panels in the broken outline open position of FIG. 2, the robotic head 80 is then moved by virtue of its own coordinate programming to a position in space to grip the ends of the camshaft. Such position in space is taken in reference to a diamond pin shape used in conjunction with a round pin shape which together gauge and position the pallet in space. Such diamond shaped pin and round shaped pin come together to engage the datum positioning bushings and adjust the pallet alignment to be in the precise relationship to the robotic head.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of the invention.

What is claimed:

1. A protective positioning pallet for holding each of a plurality of parts in an accurate spatial position, comprising:

(a) a rigid exterior skeleton frame defining a cylindrical space, said frame having positioning surfaces outside of said space for accurately orienting said frame, and locator surfaces extending into said cylindrical space for locating parts therein; and (b) one or more cradles suspended across said locator surfaces in a predetermined fixed position relative to said frame for snugly holding said parts in part-to-part separations.

2. The pallet as in claim 1, which further comprises impact shielding walls on said skeleton spaced from said cradle.

3. The pallet as in claim 2, in which said shielding walls are spaced inwardly from the periphery of said cylindrical space.

4. The pallet as in claim 1, in which said frame has a flat bed with load bearing posts projecting therefrom, each constituted of hollow tubular elements.

5. The pallet as in claim 1, in which said locator surfaces are on locator posts, said frame and locator posts being comprised of steel, and said cradle and shielding walls being comprised of tough, dimensionally stable plastic.

6. The pallet as in claim 1, in which the positioning surfaces are defined by at least a pair of bushings having an internal cylindrical surface machined and located relative to each other to a tolerance of ±0.004 inches and rigidly attached to said base.

7. The pallet apparatus as in claim 4, in which one rigid exterior skeleton frame is stackable upon another by nesting the ends of the load bearing posts within the load bearing posts of the other pallet, the loading forces of the said pallets being maintained independent of the locator posts and cradles suspended therein.

8. The pallet as in claim 1, in which the height to width ratio of said pallet is at least 1:2.

9. A protective positioning pallet for holding each of a plurality of articles in an accurate spatial position, comprising:

(a) A load bearing rigid frame and base system to define an internal cylindrical space;

(b) locator surfaces recessed within said space and protected from side forces by said frame;

(c) a cradle system accurately suspended within such space reference to said locator surfaces and separated from the periphery of such space, said cradle system being comprised of dimensionally stable and tough material that is softer than the parts contained thereby; and (d) an impact shielding wall system hung on the rigid frame to enclose the cylindrical space, such wall system being comprised of a lightweight material that has high strength and high impact toughness resistant to abuse, crushing, and deformation.

10. A method of making a protective positioning pallet, comprising:

(a) assembling a rigid frame having a bed with upright posts along the periphery of the bed to define a first interior cylindrical space;

(b) machining a plurality of reference surfaces on said frame with sufficient accuracy to define reference coordinates for said interior cylindrical space;

(c) stationing locator posts on said frame by mating machined surfaces of rigid locator posts adjacent said frame reference surfaces to obtain an accumulated stack-up of tolerances of about ±0.045 inches, said locator posts defining a second interior cylindrical space nested within said first space;

(d) suspending part-holding cradles on said locator arms to obtain an interfit therebetween of no greater than 0.045 inches; and (e) hanging shielding walls on said upright posts of said frame to close off said interior cylindrical space.

11. A method of handling parts for precision work, comprising:

(a) containerizing said parts within a positioning pallet having a rigid bed with reference locating surfaces, said parts being coordinated to said locating surfaces within an accumulated stack-up of tolerances no greater than .045 inches, said pallet having skids projecting from said bed to function as conveyor locating surfaces;

(b) conveying said pallet with said skids aligned with the sides of the conveyor to a predetermined station adjacent an unloading robot;

(c) controlling such robot to move to said predetermined station, open said container, and selectively grip one or more exposed portions of said parts in said station;

(d) robotically moving said gripped parts from said container to a work station for performing work tasks upon such parts;

(e) robotically returning said parts to said container upon completion of said work; and (f) vertically stacking said repacked containers for conveyance, each container separating and isolating the support forces from said parts.

12. The method as in claim 11, in which the pallet is a hybrid of a metal bed and frame within which is nested plastic part cradles in accurate spaced relationship to said frame.

13. The method as in claim 11, in which said bed has separate surfaces for (i) receiving forklift arms, (ii) contacting conveyor rollers, and (iii) contacting platform positioning.

14. The method as in claim 11, in which said robot is programmed to move to a point in space to grip the parts without sensing the position of the parts themselves.

* * * * *